US005915467A

United States Patent [19]

Ishikawa et al.

[11] Patent Number: 5,915,467

[45] Date of Patent: Jun. 29, 1999

[54] HEAT TRANSFER TUBE WITH GROOVES IN INNER SURFACE OF TUBE

[75] Inventors: Mamoru Ishikawa; Chikara Saeki; Nobuaki Hinago; Kiyonori Ozeki, all of Hatano, Japan

[73] Assignee: Kabushiki Kaisha Kobe Seiko Sho, Kobe, Japan

[21] Appl. No.: 09/008,080

[22] Filed: Jan. 16, 1998

[30] Foreign Application Priority Data

Jan. 17, 1997 [JP] Japan ..... 9-007051

[51] Int. Cl.[6] ..... F28F 1/40

[52] U.S. Cl. ..... 165/133; 165/183; 165/184; 165/146

[58] Field of Search ..... 165/133, 183, 165/184, 179, 146; 29/890.049, 890.053

[56] References Cited

U.S. PATENT DOCUMENTS

| | | | |
|---|---|---|---|
| 5,655,599 | 8/1997 | Kasprzyk | 165/133 |
| 5,704,424 | 1/1998 | Kohno et al. | 165/184 |

FOREIGN PATENT DOCUMENTS

| | | | |
|---|---|---|---|
| 804327 | 2/1951 | Germany | 165/183 |
| 196598 | 10/1985 | Japan | 165/133 |
| 37294 | 2/1990 | Japan | 165/133 |
| 50086 | 2/1990 | Japan | 165/133 |
| 137631 | 5/1990 | Japan | 29/890.049 |
| 158192 | 6/1992 | Japan | 165/133 |
| 158193 | 6/1992 | Japan | 165/133 |
| 283397 | 10/1992 | Japan | 165/133 |

*Primary Examiner*—Leonard R. Leo
*Attorney, Agent, or Firm*—Oblon, Spivak, McClelland, Maier & Neustadt, P.C.

[57] ABSTRACT

Disclosed is a heat transfer tube with grooves in an inner surface thereof, which is excellent in both evaporation performance and condensation performance. In the heat transfer tube with grooves in an inner surface thereof according to the present invention, groove processing regions 1 having a width W1 and groove processing regions 2 having a width W2 are alternately arranged in the inner surface thereof, and a linear groove region 3 having a width W3 extending in a longitudinal direction of the tube is arranged between the groove processing region 1 and the groove processing region 2. The width W1 is larger than the width W2. A group of grooves within the groove processing region 1 are helically formed at a torsional angle θ1 with respect to a longitudinal direction of the tube, and a group of grooves within the groove processing region 2 are at a torsional angle θ2 different from θ1 with respect to the longitudinal direction of the tube and helically formed so that a torsional direction thereof is reversed to a torsional direction of the groove processing region 1.

6 Claims, 5 Drawing Sheets

HEAT TRANSFER TUBE WITH GROOVES IN INNER SURFACE OF TUBE

BACKGROUND OF THE INVENTION

1. Field of the Invention

The present invention relates to heat transfer tube for a heat exchanger used for a room air conditioner or the like, and more particularly to a heat transfer tube with grooves in an inner surface thereof which has a high performance as an evaporator and a condenser.

2. Related Art

In the past, a heat transfer tube used for a heat exchanger is used as an evaporator and a condenser. That is, within a heat transfer tube, a refrigerant liquid is evaporated or refrigerant gas is condensed to thereby perform a heat exchanging. A conventional heat transfer tube formed with a plurality of kinds of groups of grooves in an inner surface of a metal tube is disclosed in Japanese Patent Application Laid-Open Nos. Hei 3-13796 and 4-158193 Publications.

In the heat transfer tube disclosed in Japanese Patent Application Laid-Open Nos. Hei 3-13796, a group of helical grooves are formed so as to divide a circumference of an inner surface of the tube into more than four even numbers, and these groups of helical grooves are formed so that torsional angles with respect to a direction of tube axis are mutually reversed between portions adjacent to each other. In this heat transfer tube, since there is no reverse point in an inclining direction of a groove of grooves caused by hair pin processing, it is possible to prevent the heat transfer performance in groove portions subjected to hair pin processing from being lowered. Further, by the liquid collecting action of condensed liquid at the time of condensation, a liquid film thickness in the tube is standardized so that disengagement of liquid from a groove joining portion is promoted, thus improving the condensation performance. Further, since in the inner surface of the heat transfer tube, a group of helical grooves are formed at a fixed groove pitch in a direction of tube axis, and a flat portion is provided in suitably spaced apart between the helical grooves along the tube axis, the hair pin bending processability can be improved.

In the heat transfer tube disclosed in Japanese Patent Application Laid-Open Nos. Hei 4-158193, a plurality of kinds of concavo-convex groups in a fixed spaced apart relation. The concavo-convex group comprises concave portions and groove portions, which are arranged in parallel alternately. A single concavo-convex group and concavo-convex groups adjacent to the first mentioned concavo-convex group are formed to be different in at least one or more elements out of a pitch of groove, a dimension of groove, a shape of groove and a groove direction with respect to a tube axis. Therefore, a flow of refrigerant in the tube becomes stirred up to improve the heat transfer performance. When three or more concavo-convex groups are provided, the heat transfer performance can be further improved.

On the other hand, a heat transfer tube in which a group of helical grooves and projections parallel with a tube axis direction crossing with the group of helical grooves are provided in the inner surface of a metal tube is disclosed in Japanese Patent Publication Nos. Hei 5-71874 and 6-10594 Publications. In the heat transfer tube disclosed in Japanese Patent Publication No. Hei 5-71874, the group of helical grooves is formed with the same torsional angle with respect to the tube-axis direction, and in Japanese Patent Publication No. Hei 6-10594, the groups of helical grooves formed on both sides of the projections are formed symmetrically with the projections. These heat transfer tubes are provided in the inner surface with a group of helical grooves and one or more projections parallel with the tube axis direction crossing with the group of helical grooves. A flow of refrigerant liquid within the grooves is cut off by the projection(s) to disappear a liquid film whereby the heat transfer performance can be improved. Further, since the projection parallel with the tube-axis direction is formed, a flow of refrigerant liquid in the tube-axis direction is smooth, and a pressure loss with respect to the tube-axis direction can be reduced.

However, the aforementioned conventional heat transfer tubes have the following problems. First, in the heat transfer tube disclosed in Japanese Patent Application Laid-Open No. 3-13796 Publication, the plurality of kinds of groups of helical grooves are provided, which are formed so that the torsional angles are the same and mutually reversed with respect to the tube-axis direction between portions adjacent to each other. Because of this, the refrigerant liquid in one group of grooves is impaired in flow by the other group of grooves having a reversed torsional angle. Therefore, in an evaporator in which a refrigerant liquid is supplied, which refrigerant liquid is evaporated for heat exchange, a refrigerant is not uniformly spread over the entire inner wall of the tube, lowering the evaporation performance.

In the heat transfer tube disclosed in Japanese Patent Application Laid-Open Nos. Hei 4-158193, a plurality of kinds of groups of helical grooves, which are formed to be different in at least one or more elements out of a pitch of groove with respect to the tube-axis direction between portions adjacent to each other, a dimension of groove, a shape of groove, and a torsional angle of the group of grooves with respect to the tube-axis direction. Therefore, in the conventional heat transfer tube, a flow of refrigerant is not impaired but at the time of evaporation, a pressure loss cannot be sufficiently reduced so that the evaporation performance lowers and at the time of condensation, a discharge property of condensed liquid is not enough so that a contact property between the heat transfer surface and the refrigerant gas lowers to lower the condensation performance. Further, when the group of helical grooves having the same torsional angle with respect to the tube-axis direction is provided over the entire inner surface of the tube, the condensed liquid tends to spread over the entire heat transfer surface at the time of condensation so that the heat transfer surface is covered with the condensed liquid to lower the condensation performance.

In the heat transfer tube disclosed in Japanese Patent Laid-Open No. Hei 5-71874 Publication, a plurality of groups of grooves are formed in the same direction in the entire inner surface of the tube. Therefore, the condensed liquid tends to spread over the entire heat transfer surface at the time of condensation so that even if the condensed liquid is discharged by the projections, the heat transfer surface is covered with the condensed liquid, thus lowering the condensation performance.

In the heat transfer tube disclosed in Japanese Patent Laid-Open No. Hei 6-10594 Publication, two kinds of groups of grooves are formed symmetrically between portions adjacent to each other with respect to the projections. Therefore, a flow of refrigerant liquid by one group of grooves generated at the time of evaporation becomes impaired by the other group of grooves, and when the flow of refrigerant liquid within the grooves is cut off by the projections, the refrigerant liquid is not spread over the entire heat transfer surface, thus lowering the evaporation performance.

The present invention has been achieved in view of the aforementioned problems. It is an object of the present invention to provide a heat transfer tube with grooves in an inner surface thereof for heat exchange with a refrigerant flowing through the tube, in which shapes of two kinds of group of grooves formed in the inner surface of the tube are adequately set, a plurality of sets of two kinds of groove processing regions having these groups of grooves are arranged, and a linear groove region extending in a direction of a tube-axis is arranged between the groove processing regions to thereby provide excellent evaporation performance and condensation performance.

SUMMARY OF THE INVENTION

According to the present invention, there is provided a heat transfer tube with grooves in an inner surface thereof for heat exchange with a refrigerant flowing through the tube, comprising a first group of grooves and a second group of grooves which are different in torsional angle and torsional direction with respect to a longitudinal direction of the tube, characterized in that a first groove processing region and a second groove processing region formed with said first and second group of grooves are arranged in plural sets in different width, and a linear groove region extending in a direction of tube-axis is arranged between the groove processing regions.

In the present invention, the first and second groups of grooves which are different in the torsional angle and torsional direction with respect to the longitudinal direction of the tube are formed in the inner surface of the tube, and the first and second groove processing regions formed with said first and second group of grooves are arranged in plural set in different width. In the case where the heat transfer tube is used as a evaporator, when a refrigerant liquid is supplied into the heat transfer tube, the refrigerant liquid becomes a whirl flow along the direction of the torsional angle of the group of grooves in the wide groove processing region. A whirl flow different in direction from that of the first mentioned whirl flow is generated by the group of grooves in the other groove processing region, but the groove processing region is narrow in width and different in torsional angle and torsional direction, thus not affecting on the whirl flow caused by the wide groove processing region. Therefore, the whirl flow spreads over the entire inner wall of the heat transfer tube. Further, since the linear groove region extending in a longitudinal direction of the tube is arranged between the groove processing regions, a flow of refrigerant liquid in a longitudinal direction of the tube is smooth so that a pressure loss with respect to a longitudinal direction of the tube can be reduced. Accordingly, the evaporation performance of the heat transfer tube can be improved. On the other hand, the heat transfer tube according to the present invention is used as a condenser, when a refrigerant gas is supplied to the heat transfer tube, the refrigerant gas becomes condensed and liquefied in the entire inner wall of the heat transfer tube but the condensed liquid at the outset of liquefaction is small in inertia. Therefore, even if a whirl flow of condensed liquid occurs in the direction of torsional angle of the wide groove processing region, it is suppressed in the stage at the outset of liquefaction by the group of grooves in the narrow groove processing region. Further, since the linear groove region extending in a longitudinal direction of the tube is arranged between the groove processing regions, when the condensed liquid having flown along the group of grooves impinges upon the linear groove region, it is flied by a flow of vapor so that the condensed liquid within the group of grooves disappears, thus improving the discharge property of condensed liquid. This positively prevents the entire heat transfer surface from being covered by the condensed liquid so that the heat transfer surface always comes in contact with the refrigerant gas to generate a continuous condensation. Accordingly, the condensation performance of the heat transfer tube can be improved. When the widths of the groove processing regions are W1 and W2 (W1/W2), it is requested that W1/W2 be 1.1 to 3.0.

In the case where W1/W2 is less than 1.1, even if the refrigerant flow occurs, the refrigerant flow is partly negated by the groups of grooves different in torsional direction each other. Therefore, the whirl flow is hard to occur, thus lowering the enhancement of the evaporation performance. On the other hand, in the case where W1/W2 exceeds 3.0, since the refrigerant flow at the time of condensation is affected by the group of grooves in the wide groove processing region, the whirl flow of the condensed liquid tends to occur so that the heat transfer surface is partly covered by the condensed liquid. Therefore, the enhancement of the condensation performance lowers. Accordingly, when W1/W2 is set to 1.1 to 3.0, the evaporation performance and the condensation performance can be further improved.

Further, as in claim 2, when the torsional angle of the wide groove processing region and the torsional angle of the narrow region are $\theta 1$ and $\theta 2$, respectively, $\theta 1<\theta 2$, and the torsional direction between the adjacent groove processing regions is reversed, $4° \leqq \theta 1 \leqq 25°$ and $8° \leqq \theta 2 \leqq 45°$, then it is possible to obtain a heat transfer tube which is particularly excellent in air-conditioning. That is, in the case of $\theta 1<\theta 2$, when $\theta 1<4°$ or $\theta 2<8°$, the pressure loss at the time of evaporation is small, and the evaporation performance is high whereas the liquid collecting effect at the time of condensation lowers and the enhancement of the condensation performance lowers. On the other hand, when $\theta 1>25°$ or $\theta 2>45°$, the condensation performance is high but the pressure loss at the time of evaporation is high, making it difficult to design a heat exchanger. Accordingly, when $\theta 1<\theta 2$, and the torsional direction between the adjacent groove processing regions is reversed, $4° \leqq \theta 1 \leqq 25°$ and $8° \leqq \theta 2 \leqq 45°$, particularly, the evaporation performance is further excellent so that the air-conditioning ability can be improved.

Further, as in claim 3, when the torsional angle of the wide groove processing region and the torsional angle of the narrow region are $\theta 1$ and $\theta 2$, respectively, $\theta 1>\theta 2$, and the torsional direction between the adjacent groove processing regions is reversed, $8° \leqq \theta 1 \leqq 45°$ and $4° \leqq \theta 2 \leqq 25°$, then it is possible to obtain a heat transfer tube which is particularly excellent in heating ability. That is, in the case of $\theta 1>\theta 2$, when $\theta 1<8°$ or $\theta 2<4°$, the pressure loss at the time of evaporation is small, and the evaporation performance is high whereas the liquid collecting effect at the time of condensation lowers and the enhancement of the condensation performance lowers. On the other hand, when $\theta 1>25°$ or $\theta 2>45°$, the condensation performance is high but the pressure loss at the time of evaporation is high, lowering the enhancement of the evaporation performance. Accordingly, when $\theta 1>\theta 2$, and the torsional direction between the adjacent groove processing regions is reversed, $8° \leqq \theta 1 \leqq 45°$ and $4° \leqq \theta 2 \leqq 25°$, particularly, the condensation performance is further excellent so that the heating ability can be improved.

Furthermore, as in claim 4, when the width of the linear groove region is W3, and the groove pitch in a cross-section in the case cut at right angles to a longitudinal direction of the tube in the first and second groove processing regions is P, it is preferable that the W3/P ratio is 1.0 to 3.0.

In the case where the W3/P ratio is less than 1.0, a sectional-area ratio of the linear groove region with respect to the groove processing region is small, and the resistance of a flow of refrigerant flow increases so that the pressure loss at the time of evaporation increases and the discharge property of the refrigerant liquid at the time of condensation lowers. On the other hand, in the case where the W3/P ratio exceeds 3.0, the surface area of the groove processing region within the tube is small, and therefore, the enhancement of the evaporation performance and the condensation performance lowers. Accordingly, it is preferable that the W3/P ratio is 1.0 to 3.0.

Moreover, as in claim 5, when the wall thickness of the linear groove region is t0, and the average wall thickness of the first and second groove processing regions is t, it is preferable that $0.9t \leqq t0 \leqq 1.1$. In this case, when the wall thickness of the linear groove region is equal to that of the bottom of the groove processing region, a crack occurs in the heat transfer tube due to the internal pressure or the like. When $0.9t \leqq t0 \leqq 1.1$, even if the heat transfer tube is spread upon receipt of internal pressure or the like, the concentration of stress can be relieved to prevent the strength from being lowered. Note, the average thickness t of the first and second groove processing regions is a total thickness of a thickness of a groove and a wall thickness of bottom tb in the case where the concavo-convex of the group of grooves is made flat.

Further, as in claim 6, it is preferable that the wall thicknesses of the first and second groove processing regions are thicker as they come close to the linear groove region. When the wall thicknesses of the first and second groove processing regions are made to be thicker as they come close to the linear groove region, the flowability of the refrigerant liquid can be secured to maintain the high heat transfer performance.

DESCRIPTION OF THE PREFERRED EMBODIMENTS

Figure 1:
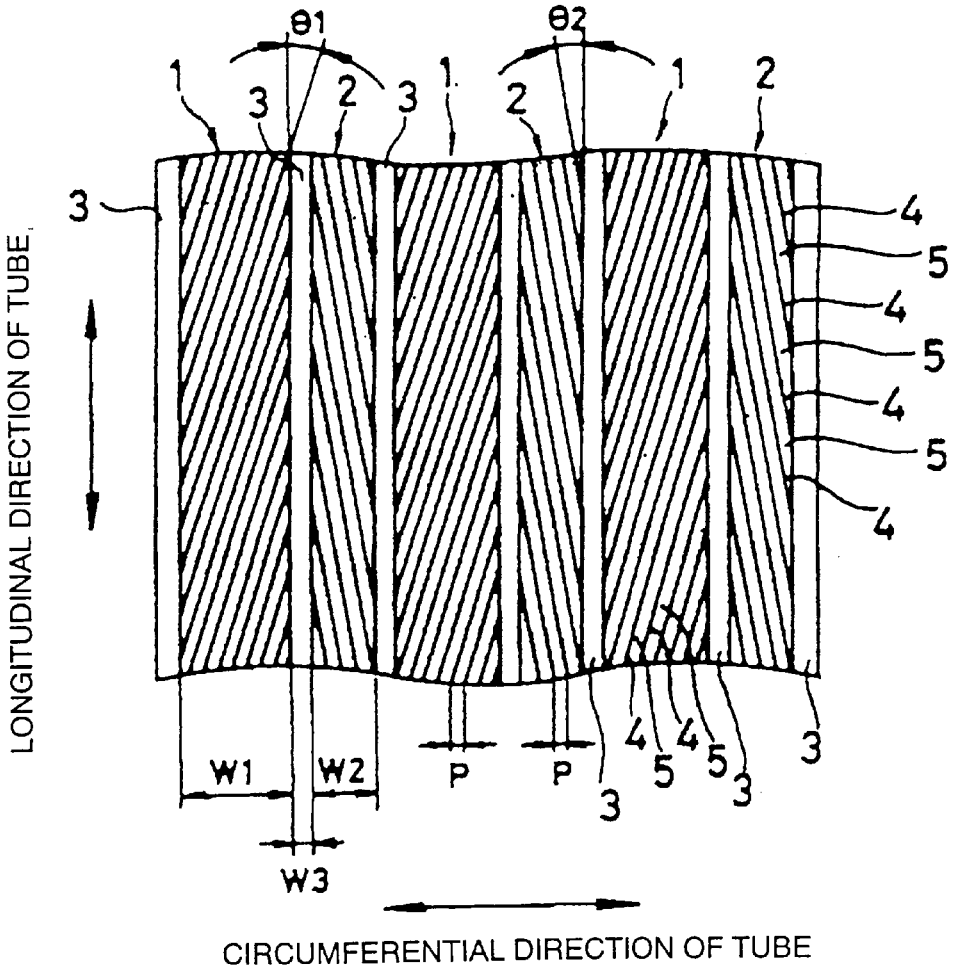
FIG. 1 is a schematic view showing, in a developed form, an inner surface of a heat transfer tube with grooves formed in the inner surface thereof.
Figure 2:
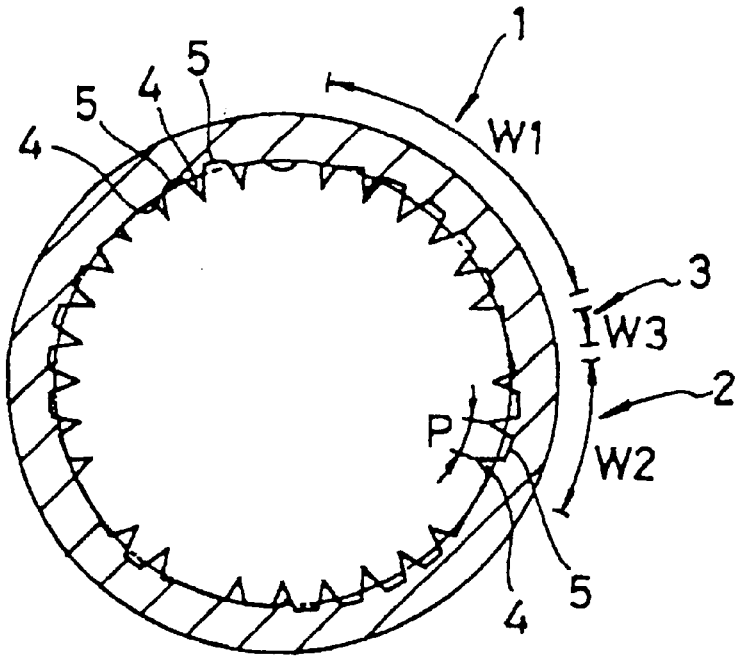
FIG. 2 is a sectional view of the heat transfer tube with grooves formed in the inner surface thereof according to an embodiment of the present invention (a cross-section taken at right angles to a longitudinal direction of the tube)
Figure 3:
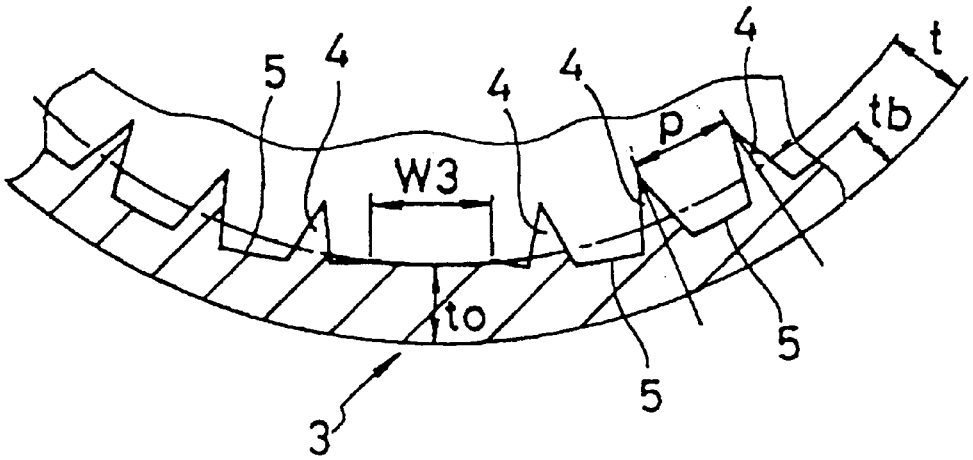
FIG. 3 is a sectional view showing, in an enlarged scale, a part of the heat transfer tube with grooves formed in the inner surface thereof according to the embodiment of the present invention.

Embodiments of the present invention will be described hereinafter in detail with reference to the accompanying drawings. FIG. 1 is a schematic view showing an inner surface of a heat transfer tube according to an embodiment of the present invention in a developed form, and FIG. 2 is a sectional view thereof (a cross-section taken at right angles to a longitudinal direction of the tube). In the heat transfer tube according to the present invention, groove processing regions 1 of width W1 and groove processing regions 2 of width W2 are alternately arranged in the inner surface thereof, and a linear groove region 3 of width W3 is extended and arranged in a direction of a tube axis (in a longitudinal direction of the tube) between the respective groove processing region 1 and the groove processing region 2. The width W1 is larger than the width W2. As shown in FIGS. 1 and 2, in the groove processing regions 1 and 2, a group of grooves are formed, the group of grooves comprising groove convex portions 4 and grove concave portions 5, the groove convex portions 4 and the groove concave portions 5 being formed alternately. The groove convex portions 4 and the groove concave portions 5 are formed at pitches P. The pitches P need not always be the same. The group of grooves in the groove processing region 1 are helically formed at an torsional angle θ1 with respect to the tube-axis direction, and the group of grooves in the groove processing region 2 are at an torsional angle θ2 with respect to the tube-axis direction, torsional direction of which is helically formed in a direction reverse to the torsional direction of the groove processing region 1. Note, the torsional angle θ2 is different from the torsional angle θ1. FIG. 3 is a sectional view showing a part of the heat transfer tube in an enlarged scale. The group of grooves in the groove processing regions 1 and 2 have their wall thickness which becomes thicker as it comes closer to the linear groove region 3 from a bottom wall-thickness (the thinnest wall-thickness in the groove processing regions) tb, which average wall-thickness is t. The wall-thickness in the linear groove region is t0, which is in a relation of $0.9t \leqq t0 \leqq 1.1t$.

In the case where the thus constructed heat transfer tube is first used as an evaporator, when a refrigerant liquid is supplied into the heat transfer tube, this refrigerant is changed into a whirl flow along the direction of the torsional angle θ1 of the group of grooves within the groove processing region 1. A whirl flow different in direction from that of the first mentioned whirl flow occurs in the group of grooves in the groove processing region 2. However, since the groove processing region 2 is narrow in width and different in torsional angle, it does not influence on the whirl floe caused by the groove processing region 1 having a large width. Because of this, the whirl flow spreads over the entire inner wall of the heat transfer tube. Further, since the linear groove region 3 extending in a direction of tube axis (in a longitudinal direction of tube) is arranged between the groove processing region 1 and the groove processing region 2, a flow of a refrigerant in a direction of tube axis is so smooth that a pressure loss with respect to the direction of tube axis can be reduced. Accordingly, the evaporation performance of the heat transfer tube can be improved. Note, if the torsional angle θ1 is made small, even if the flow rate of refrigerant is made small, the whirl flow of refrigerant tends to occur whereby a turbulence is generated by the groove of grooves at the torsional angle θ2, whereby the evaporation performance can be further improved.

On the other hand, in the case where the heat transfer tube is used as a condenser, when a refrigerant gas is supplied to the heat transfer tube, the refrigerant gas becomes condensed and liquefied in the entire inner wall of the heat transfer tube, but a condensed liquid at the outset of liquefaction is small in inertia of flow. Therefore, even if a whirl flow of condensed liquid occurs in the direction of the torsional angle θ1 of the groove processing region 1, it is suppressed in the state at the outset of liquefaction by the group of grooves of the groove processing region 2. Further, since the linear groove region 3 extending in a direction of tube axis is arranged between the groove processing region 1 and the groove processing region 2, when the condensed liquid having flown along the group of grooves impinges upon the linear groove region 3, it is flied by a vapor flow so that the condensed liquid within the group of grooves disappears, whereby the discharge property of the condensed liquid is improved. This positively prevents the entire heat transfer surface from covered by the condensed liquid, and the heat transfer surface always comes in contact with the refrigerant gas, as a result of which a continuous condensation occurs. Accordingly, the condensation performance of the heat transfer tube can be improved.

Furthermore, the linear groove region 3 has its wall thickness formed to be a predetermined range with respect to an average wall thickness of the groove processing region. Therefore, even if the heat transfer tube is spread out by an internal force or the like, concentration of stress is relieved to prevent the strength from being lowered. However, in this case, since the group of grooves is constructed to be dammed up by the liner groove region 3, a flow of refrigerant liquid is impaired to lower the enhancement of the evaporation performance and the condensation performance. However, since in the present embodiment, the wall thickness of the groove processing regions 1 and 2 is formed to be thicker as they come closer to the linear groove region 3, the flowability of the refrigerant liquid is secured so that higher heat transfer performance is maintained.

In the present invention, the groove processing regions 1 and the groove processing regions 2 in the inner surface of the tube need not be arranged alternately but the order thereof may be rearranged suitably within the range not to impair the effect of the present invention. In this case, however, the linear groove region 3 is arranged between the groove processing regions.

EXAMPLES

In the following, special features of a heat transfer tube with grooves in an inner surface thereof manufactured according to the present invention will be described in detail comparing with comparative examples.

Example 1

Figure 4:
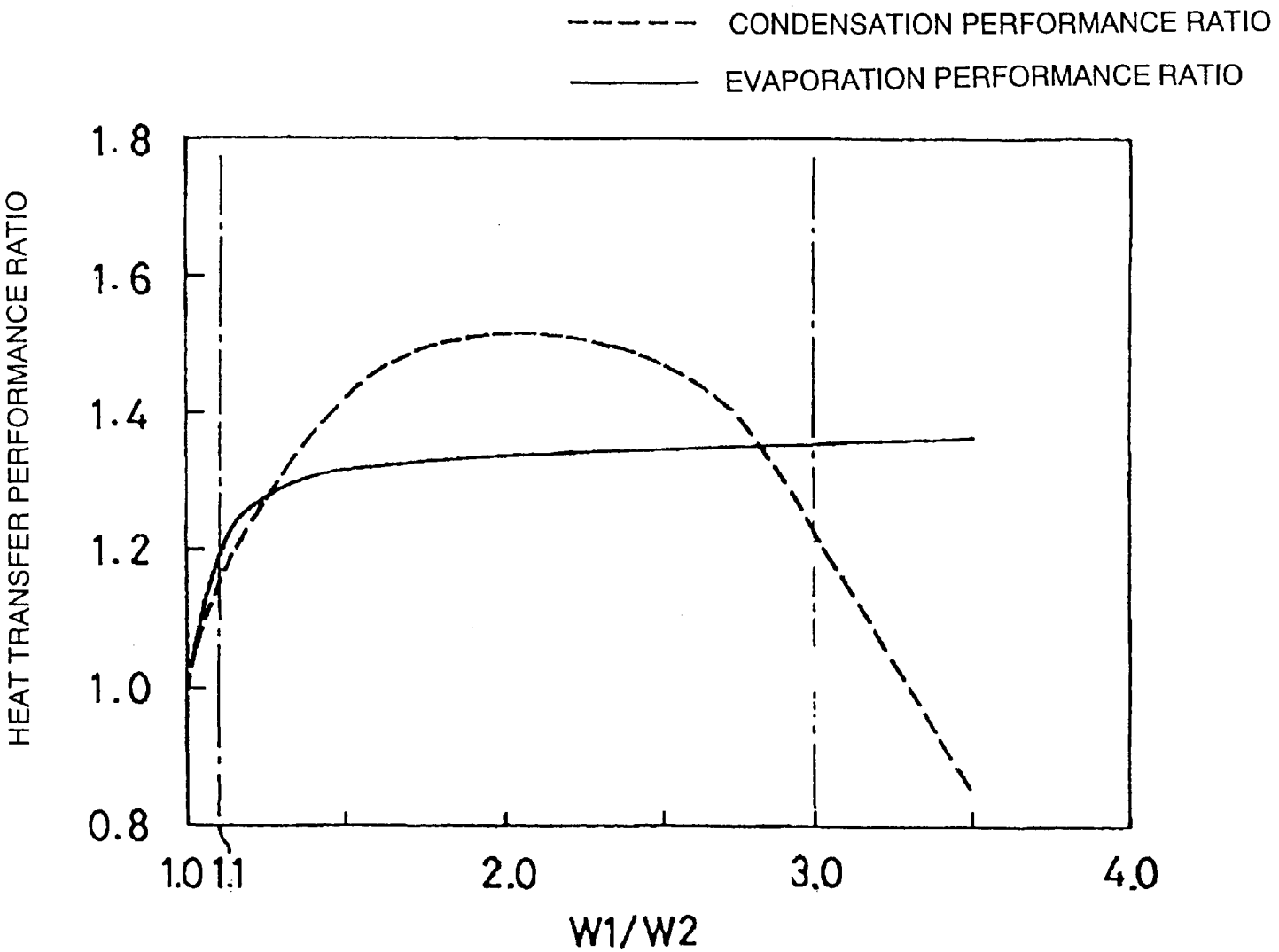
FIG. 4 is a graphic representation showing a relationship between W1/W2 and a heat transfer performance ratio, an axis of abscissae showing a width ratio W1/W2 of a groove processing region, an axis of ordinates showing a heat transfer performance ratio.

First, a group of grooves having a depth of 0.2 mm were molded on one surface of a copper plate with a pitch of 0.2 mm by rolling, two groove processing regions being changed in shape. That is, with respect to these two groove processing regions, in a wide (width W1) groove processing region 1 as shown in FIG. 1, a torsional angle θ1 of a group of grooves was formed in a right hand thread in a range of 2 to 60° with respect to a direction of tube-axis (in a longitudinal direction of a tube) while in a narrow (width W2) groove processing region 2, a torsional angle 2 of a group of grooves was formed in a left hand thread in a range of 2 to 60° with respect to a direction of tube-axis, and a width ratio (W1/W2) between these groove processing regions was variously changed in a range of 1.0 to 3.5. Then, a linear groove region 3 extending in a direction of tube-axis was arranged between the groove processing region 1 and the groove processing region 2. Next, the groove forming surface was curved internally, and ends of the copper plate were butted with each other and welded by high frequency welding to thereby obtain a heat transfer tube having an outside diameter of 7 mm. The resultant heat transfer tube was arranged internally of a double tube type heat exchanger having a length of 3,000 m (hereinafter merely referred to as an outer tube), and after this, a refrigerant was supplied to the heat transfer tube. Water was supplied to an annular portion between the heat transfer tube and the outer tube for heat exchange to evaluate a heat transfer performance (evaporation performance and condensation performance). The results of the heat transfer performance are shown in FIG. 4. FIG. 4 is a graphic representation showing a relationship between W1/W2 and a heat transfer performance ratio, an axis of ordinates showing a width ratio W1/W2 of a groove processing region, an axis of abscissae showing a heat transfer performance ratio (evaporation performance ratio and condensation performance ratio). Note, the heat transfer ratio shows the relative value with the heat transfer performance value being a reference in the case where the width W1 is equal to W2.

As will be apparent from FIG. 4, in the case where W1/W2 is in the range of 1.1 to 3.0, the evaporation performance and the condensation performance are further excellent. On the other hand, when W1/W2 is less than 1.1, the enhancement of both the evaporation performance and the condensation performance lowers, and W1/W2 exceeds 3.0, the evaporation performance is high and excellent but the condensation performance lowers.

Example 2

First, a group of grooves having a depth of 0.2 mm were molded on one surface of a copper plate with a pitch of 0.2 mm by rolling, and at the same time, two groove processing regions different in width were changed in shape. That is, with respect to these two groove processing regions, as shown in FIG. 1, a torsional angle θ1 of a groove processing region 1 having a width W1 was variously changed in a range of 2 to 60° with respect to a direction of tube-axis (in a longitudinal direction) so as to be in a direction of a right hand thread while a torsional angle θ2 of a groove processing region 2 having a width W2 was variously changed in a range of 2 to 60° with respect to a direction of tube-axis so as to be in a direction of a left hand thread. A width ratio (W1/W2) between the groove processing regions was 2.0. Then, a linear groove region 3 extending in a direction of tube-axis was arranged between the groove processing region 1 and the groove processing region 2. Next, the groove forming surface was curved internally, and ends of the copper plate were butted with each other and welded by high frequency welding to thereby obtain a heat transfer tube having an outside diameter of 7 mm. The resultant heat transfer tube was arranged internally of an outer tube having a length of 3,000 m, and after this, a refrigerant was supplied into the heat transfer tube in a flowrate of 30 kg/time. Water was supplied to an annular portion between the heat transfer tube and the outer tube for heat exchange to evaluate a heat transfer performance (evaporation performance and condensation performance) and a pressure loss ratio. With respect to the results, the groove shapes (torsional angles θ1, θ2), the heat transfer performance and the pressure loss are shown in Table 1 below. Note, the heat transfer ratio shows the relative value with the heat transfer performance value being a reference in the case where the width W1 is equal to W2.

TABLE 1

| | No. | Shape of Groove | | Result of Evaporation Test | | Result of Condensation Test | |
|---|---|---|---|---|---|---|---|
| | | Torsional Angle θ 1 (deg.) | Torsional Angle θ 2 (deg.) | Heat Transfer Performance ratio | Pressure Loss Ratio | Heat Transfer Performance ratio | Pressure Loss Ratio |
| Examples | 1 | 5 | 20 | 1.5 | 1.2 | 1.1 | 1.2 |
| | 2 | 15 | 40 | 1.4 | 1.1 | 1.3 | 1.3 |
| | 3 | 20 | 15 | 1.3 | 1.2 | 1.5 | 1.2 |
| | 4 | 40 | 20 | 1.2 | 1.1 | 1.6 | 1.3 |
| Comp. Examples | 1 | 2 | 15 | 1.2 | 1.0 | 1.1 | 1.0 |
| | 2 | 30 | 60 | 1.2 | 1.7 | 1.3 | 2.0 |
| | 3 | 5 | 2 | 1.1 | 1.0 | 1.1 | 1.0 |
| | 4 | 60 | 30 | 1.2 | 2.1 | 1.7 | 2.0 |

As shown in Table 1, in the case where the torsional angle θ1 is smaller than the torsional angle θ2, both the evaporation performance and the condensation performance in Examples 1 and 2 were excellent, and particularly the evaporation performance was extremely excellent. On the other hand, out of Comparative Examples, in Comparative Example 1, since the torsional angle θ1 is smaller than a predetermined value, the enhancement of the condensation performance was small. In Comparative Example 2, since both the torsional angles θ1 and θ2 are larger than a predetermined value, the pressure loss ratio at the time of evaporation was high.

On the other hand, in the case where the torsional angle θ1 is larger than the torsional angle θ2, in Examples 3 and 4, both the evaporation performance and the condensation performance were excellent, and particularly the condensation performance was extremely excellent.

On the other hand, in Comparative Examples, the evaporation performance and the condensation performance were excellent. However, since in Comparative Example 3, both the torsional angles θ1 and θ2 are smaller than a predetermined value, the enhancement of the evaporation performance was small. Since in Comparative Example 4, both the torsional angles θ1 and θ2 are larger than a predetermined value, the reduction in the pressure loss ratio at the time of evaporation was small.

Example 3

Figure 5:
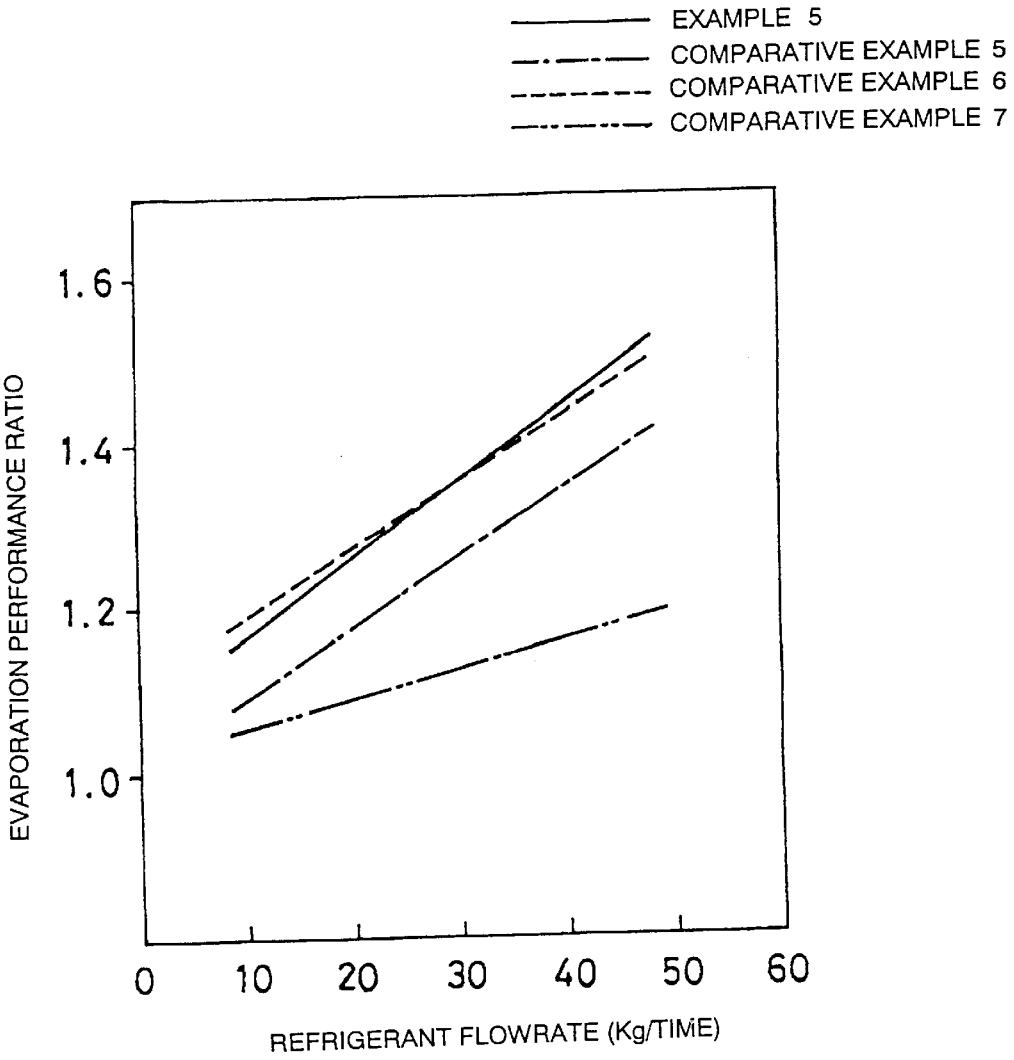
FIG. 5 is a graphic representation showing a relationship between a refrigerant flowrate and a vaporization performance ratio, an axis of abscissae showing a refrigerant flowrate, an axis of ordinates showing a vaporization performance ratio.
Figure 6:
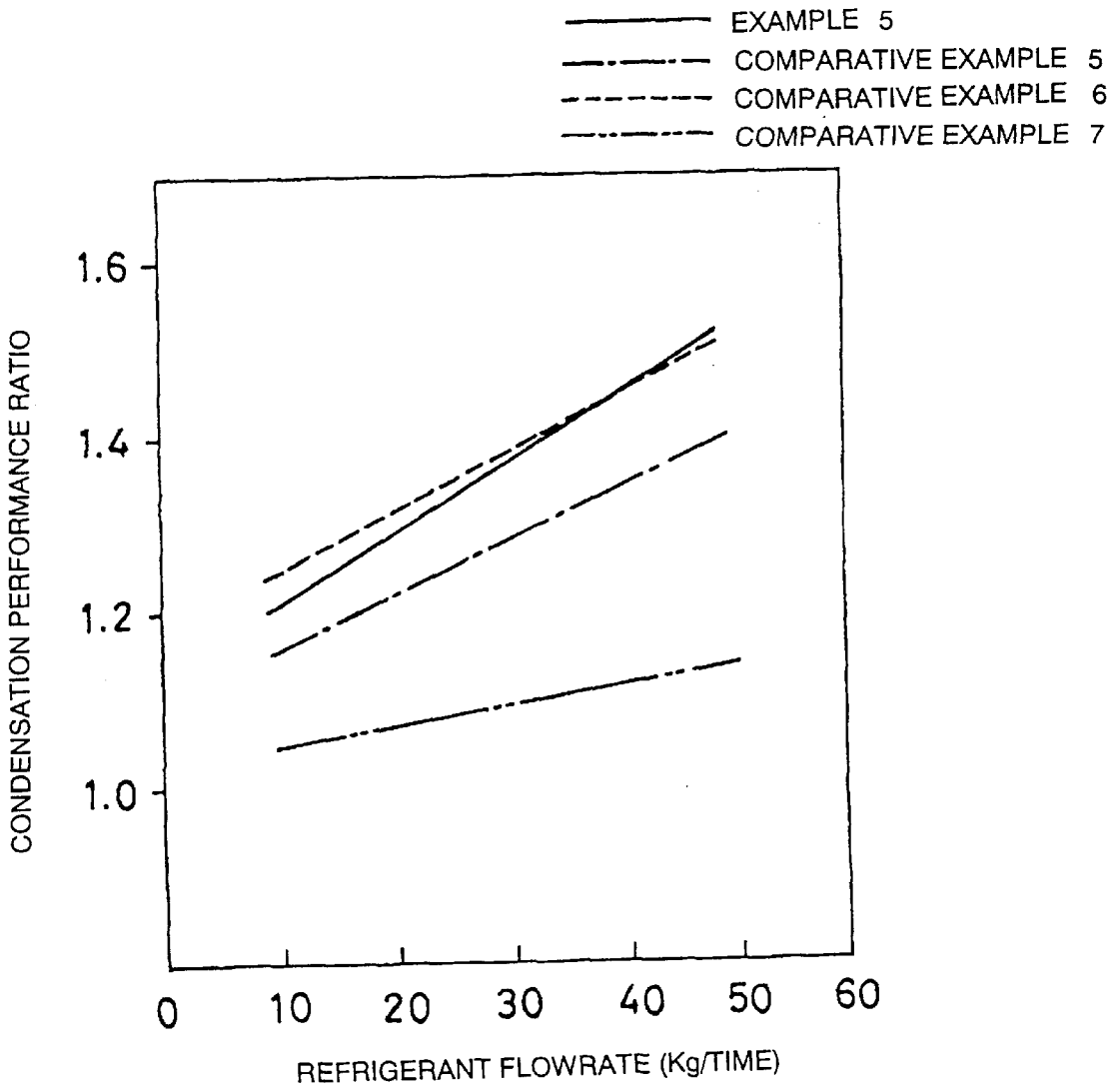
FIG. 6 is a graphic representation showing a relationship between a refrigerant flowrate and a condensation performance ratio, an axis of abscissae showing a refrigerant flowrate, an axis of ordinates showing a condensation performance ratio.

First, a group of grooves having a depth of 0.2 mm was formed at pitches 0.2 mm on one surface of a copper plate by rolling. In two groove processing regions, a width ratio (W1/W2) therebetween was set to 1.0 to 3.5, torsional angles θ1 and θ2 were set in a range of 2 to 60°, and a torsional direction of the groove processing region 1 and a torsional direction of the groove processing region 2 were formed to be a right-hand thread direction and a left-hand thread direction, respectively. Thereafter, shapes of the groove processing regions 1 and 2 were variously changed. That is, a linear groove region 3 was arranged and wall thicknesses of the groove processing regions 1 and 2 were formed to have thicker as they come closer to the linear groove region 3 to constitute Example 5. As Comparative Examples, the linear groove region 3 was arranged and the thicknesses of the groove processing regions 1 and 2 were made constant, the linear groove region 3 was arranged and the thicknesses of the groove processing regions 1 and 2 were made a wall thickness tb of bottom (a wall thickness of the thinnest portion in the groove processing region), and the linear groove region 3 was not arranged, to constitute Comparative Examples 5, 6 and 7, respectively. Next, a groove forming surface was curved internally, and ends of the copper plate were butted and high frequency welded to obtain a heat transfer tube having an outside diameter of 7 mm. These heat transfer tubes were arranged internally of an outer tube having a length of 3,000 m, after which a refrigerant was supplied into the heat transfer tube, and water was supplied to an annular portion between the heat transfer tube and the outer tube to evaluate the heat transfer performance (evaporation performance and condensation performance) with respect to the refrigerant flowrate. These results are shown in FIGS. 5 and 6. FIG. 5 is a graphic representation showing a relationship between a refrigerant flowrate and a vaporization performance ratio, an axis of abscissae showing a refrigerant flowrate, an axis of ordinates showing a vaporization performance ratio; and FIG. 6 is a graphic representation showing a relationship between a refrigerant flowrate and a condensation performance ratio, an axis of abscissae showing a refrigerant flowrate, an axis of ordinates showing a evaporation performance ratio. Note, the heat transfer performance ratio shows the relative value with the heat transfer performance value being a reference in the case where the width W1 is equal to W2.

As shown in FIGS. 5 and 6, in Example 5 of the present invention, the evaporation performance and the condensation performance were extremely excellent. On the other hand, Comparative Examples 5 to 7 were inferior in evaporation performance and condensation performance to Example 5. However, Comparative Examples 5 and 6 in which the linear groove region extending in a direction of tube-axis were excellent in evaporation performance and condensation performance as compared with Comparative Example 7 in which the linear groove region is not arranged.

Example 4

First, a group of grooves having a depth of 0.2 mm was formed at pitches 0.2 mm on one surface of a copper plate by rolling. In two groove processing regions, a width ratio (W1/W2) therebetween was set to 1.0 to 3.0, torsional angles θ1 and θ2 were set in a range of 4 to 45°, and a width W3 of a linear groove region extending in a direction of tube-axis between two groove processing regions was set so that W3/P is 0.8 to 3.5 with respect to a groove pitch P. Next, a groove forming surface is curved internally, and ends of the copper plate were butted with each other and high frequency welded to obtain a heat transfer tube having an outside diameter of 7 mm. With respect to these heat transfer tubes, the heat transfer performance (condensation performance and evaporation performance) was evaluated in the manner as described above. The following Table 2 shows W3/P showing the shape of grooves, the heat transfer performance ratio and the pressure performance ratio. The heat transfer performance ratio shows the relative vale with the heat transfer performance value being a reference in the case where the width W1 is equal to W2.

TABLE 2

| | | | Result of Evaporation Test | | Result of Condensation Test | |
|---|---|---|---|---|---|---|
| | No. | Shape of Groove W3/P | Heat Transfer Performance Ratio | Pressure Loss Ratio | Heat Transfer Performance Ratio | Pressure Loss Ratio |
| Example | 6 | 2.0 | 1.3 | 1.2 | 1.5 | 1.2 |
| Comp. | 8 | 0.8 | 1.2 | 1.5 | 1.2 | 1.4 |
| Examples | 9 | 3.5 | 1.1 | 0.9 | 1.2 | 1.1 |

As shown in Table 2, in Example 6, the evaporation performance and the condensation performance were further excellent. On the other hand, in Comparative Example 8, since W3/P is less than 1.0, the pressure loss at the time of evaporation increased, and the discharge property of condensed liquid lowered and the condensation performance lowered. In Comparative Example 9, since W3/P exceeds 3.0, the heat transfer area reduced, and both the condensation performance and the evaporation performance lowered.

Example 5

First, a group of grooves having a depth of 0.2 mm was formed at pitches 0.2 mm on one surface of a copper plate by rolling. In two groove processing regions, a width ratio (W1/W2) therebetween was set to 1.0 to 3.5, torsional angles θ1 and θ2 were set in a range of 2 to 60°, and a torsional direction of the groove processing region 1 and a torsional direction of the groove processing region 2 were formed to be a right-hand thread direction and a left-hand thread direction, respectively. In the groove processing regions 1 and 2, an average wall thickness was 0.3 mm, and a bottom wall thickness was 0.25 mm. Next, a linear groove region 3 extending in a direction of tube-axis between two groove processing regions was variously changed in its wall thickness t0. Next, the groove forming surface was curved internally, and ends of the copper plate were butted with each other and welded by high frequency welding to thereby obtain a heat transfer tube having an outside diameter of 7 mm. A pressure withstanding value of the heat transfer tube was evaluated to examine a burst part. The following Table 3 shows a wall thickness t0 of the groove processing region, the pressure withstanding and the burst part.

TABLE 3

| | No. | Wall thickness t0 (mm) | Pressure Withstanding (MPa) | Burst Part |
|---|---|---|---|---|
| Example | 7 | 0.30 | 16.7 | Groove processing region |
| Comp. | 10 | 0.25 | 14.7 | Linear groove region |
| Examples | 11 | 0.23 | 13.7 | Linear groove region |

As shown in Table 3, since in Example 7, the wall thickness t0 of the linear groove region is in a predetermined range, the pressure withstanding was high, 16.7 MPa, and the burst part was in the groove processing region. On the other hand, since in Comparative Examples 10 and 11, the burst part was in the linear groove region, the pressure withstanding was also low.

As described above, in the heat transfer tube with grooves in an inner surface thereof according to the present invention, the first and second groups of grooves different in torsional angle and torsional direction with respect to the longitudinal direction of the tube are formed in the inner surface of the tube, and a plurality of sets of the first and second groove processing regions formed with the first and second group of grooves are arranged in different width, and the linear groove region extending in a longitudinal direction of the tube is arranged between the groove processing regions. Therefore, the evaporation performance and the condensation performance of the heat transfer tube can be made excellent. Since the heat transfer tube has the excellent condensation performance, a freedom of design of a heat exchanger can be enhanced, and energy saving and high efficiency can be achieved. When W1/W2 which is the ratio between width W1 of the first groove processing region and width W2 of the second groove processing region is in a predetermined range, the evaporation performance and the condensation performance can be further improved.

Further, as set forth in claim 2, when the torsional angle θ1 of the first groove processing region is made smaller than the torsional angle θ2 of the second groove processing region, the torsional direction is reversed between the adjacent groove processing regions, and the torsional angle θ1 and the torsional angle θ2 are in a predetermined range, particularly, the evaporation performance is further improved, and the air-conditioning ability can be made excellent.

Further, as set forth in claim 3, when the torsional angle θ1 of the first groove processing region is made larger than the torsional angle θ2 of the second groove processing region, the torsional direction is reversed between the adjacent groove processing regions, and the θ1 and θ2 are in a predetermined range, particularly, the condensation performance is enhanced, and the heating ability can be made excellent.

Furthermore, as set forth in claim 4, when the width W3 of the linear groove region is set to a predetermined range with respect to the groove pitch P, the evaporation performance and the condensation performance can be further enhanced.

Moreover, as set forth in claim 5, when the wall thickness t0 of the linear groove region is set to a predetermined range with respect to the average wall thickness t of the groove processing region, even if the heat transfer tube is spread due to the internal force or the like, the concentration of stress can be relieved to prevent the strength from being lowered.

Further, as set forth in claim 6, when the wall thickness of the groove processing region is formed to be thicker as it comes closer to the liner groove region, the flowability of the refrigerant liquid can be secured to maintain the high heat transfer performance.

The entire disclosure of Japanese Patent Application NO. 9-7051 filed on Jan. 17, 1997 including specification, claims, drawings and summary are incorporated herein by reference in its entirety.

What is claimed is:

1. A heat transfer tube with grooves in an inner surface thereof, comprising:

a plurality of first groove processing regions, each of said first groove processing regions having a plurality of first grooves extending at a torsional angle with respect to a longitudinal direction of the tube;

a plurality of second groove processing regions, each of said second groove processing regions having a plurality of second grooves extending at another torsional angle with respect to the longitudinal direction of the tube, wherein imaginary lines extending said first grooves cross imaginary lines extending said second grooves; and a linear groove region extending in the longitudinal direction of the tube and arranged between said groove processing regions, wherein $$W1/W2=1.1 \text{ to } 3.0,$$

where W1 is the width of each of said first groove processing regions, and W2 is the width of each of said second groove processing regions.

2. The heat transfer tube with grooves in an inner surface thereof according to claim 1, wherein when a torsional angle of a wide one of said groove processing regions and a torsional angle of a narrow one thereof are $\theta 1$ and $\theta 2$, respectively, $\theta 1<\theta 2$, a torsional direction is reversed between the adjacent groove processing regions, and $4° \leqq \theta 1 \leqq 25°$, $8° \leqq \theta 2 \leqq 45°$.

3. The heat transfer tube with grooves in an inner surface thereof according to claim 1, wherein when a torsional angle of a wide one of said groove processing regions and a torsional angle of a narrow one thereof are $\theta 1$ and $\theta 2$, respectively, $\theta 1>\theta 2$, a torsional direction is reversed between the adjacent groove processing regions, and $8° \leqq \theta 1 \leqq 45°$, $4° \leqq \theta 2 \leqq 25°$.

4. The heat transfer tube with grooves in an inner surface thereof according to claim 1 to 3, wherein when the width of said linear groove region is W3 and a groove pitch in a cross-section taken at right angle to a longitudinal direction of the tube in said first and second groove processing regions is P, the W3/P ratio is 1.0 to 3.0.

5. The heat transfer tube with grooves in an inner surface thereof according to claim 1 to 4, wherein when a wall thickness of said linear groove region is t0 and an average wall thickness of said first and second groove processing regions is t, $0.9t \leqq t0 \leqq 1.1t$.

6. The heat transfer tube with grooves in an inner surface thereof according to claim 1 to 5, wherein the wall thickness of said first groove processing region and said second groove processing region becomes thicker as they come closer to said linear groove region.

* * * * *